United States Patent [19]

Kimball et al.

[11] 4,038,742

[45] Aug. 2, 1977

[54] METHOD OF MAKING STYROFOAM SLOTTED PLANE-ARRAY ANTENNA

[75] Inventors: John K. Kimball, Pepperell; Troy E. Plunk, Bedford, both of Mass.

[73] Assignee: The United States of America as represented by the Secretary of the Army, Washington, D.C.

[21] Appl. No.: 723,352

[22] Filed: Sept. 15, 1976

[51] Int. Cl.[2] ..... H01P 11/00; H01Q 13/00

[52] U.S. Cl. ..... 29/600; 156/150; 156/250; 156/330; 343/771

[58] Field of Search ..... 29/600, 592, 458; 156/150, 151, 250, 330; 204/20, 22; 343/771, 767, 768, 708

[56] References Cited

U.S. PATENT DOCUMENTS

| | | | |
|---|---|---|---|
| 3,346,865 | 10/1967 | Jones, Jr. | 343/771 |
| 3,482,248 | 12/1969 | Jones, Jr. | 343/771 X |
| 3,914,767 | 10/1975 | Jones, Jr. | 343/708 |

*Primary Examiner*—Victor A. DiPalma

*Attorney, Agent, or Firm*—Nathan Edelberg; Robert P. Gibson; Robert C. Sims

[57] ABSTRACT

A copper plated styrofoam dielectric planar array antenna having adjacent slotted waveguide sections bonded with a silver loaded conducting epoxy. The sections are fabricated by plating a thin film of copper on a preformed styrofoam dielectric material. The slots are machined into the copper plated sections.

1 Claim, 5 Drawing Figures

METHOD OF MAKING STYROFOAM SLOTTED PLANE-ARRAY ANTENNA

DEDICATORY CLAUSE

The invention described herein may be manufactured, used, and licensed by or for the Government for governmental purposes without the payment to us of any royalties thereon.

DESCRIPTION OF THE PREFERRED EMBODIMENT

Figure 1:
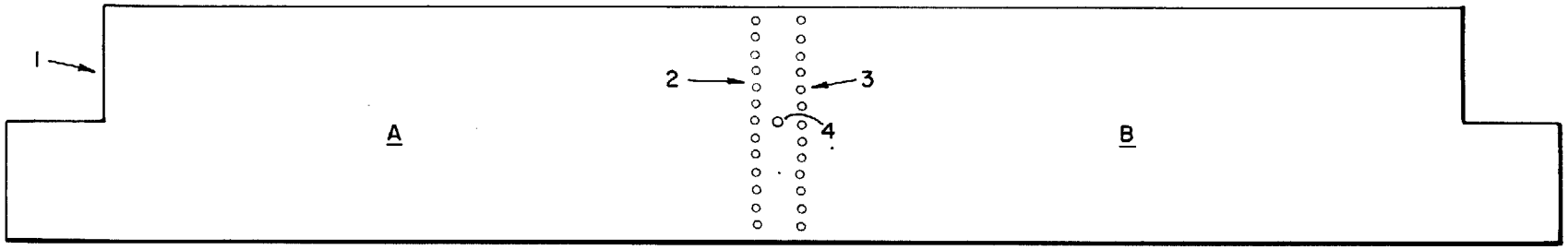
FIG. 1 is a diagrammatic showing of one of the sections of the present invention.
Figure 2:
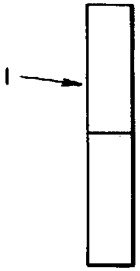
FIG. 2 is a side view of FIG. 1.

FIGS. 1 and 2 show the basic section of the antenna. The section 1 is made of styrofoam and forms the basic building block of the waveguide array. HD 300 styrofoam which has a loss tangent of approximately 0.0004 and a relative dielectric constant of 1.07 is used to make the sections one. HD 300 styrofoam is a closed cell material which is easily machined to a relatively smooth surface. The styrofoam section has a layer of copper deposited thereon. The two columns of holes 2 and 3 are plated through holes and form short circuits in the waveguide 1. Thus each section is comprised of two waveguide sections A and B. The hole 4 in the center is used for alignment purposes. The corners on the end of the waveguide sections are included as a convenient means for locating the centerline of the waveguide so that the radiating slots may be milled in the proper location.

Figure 3:
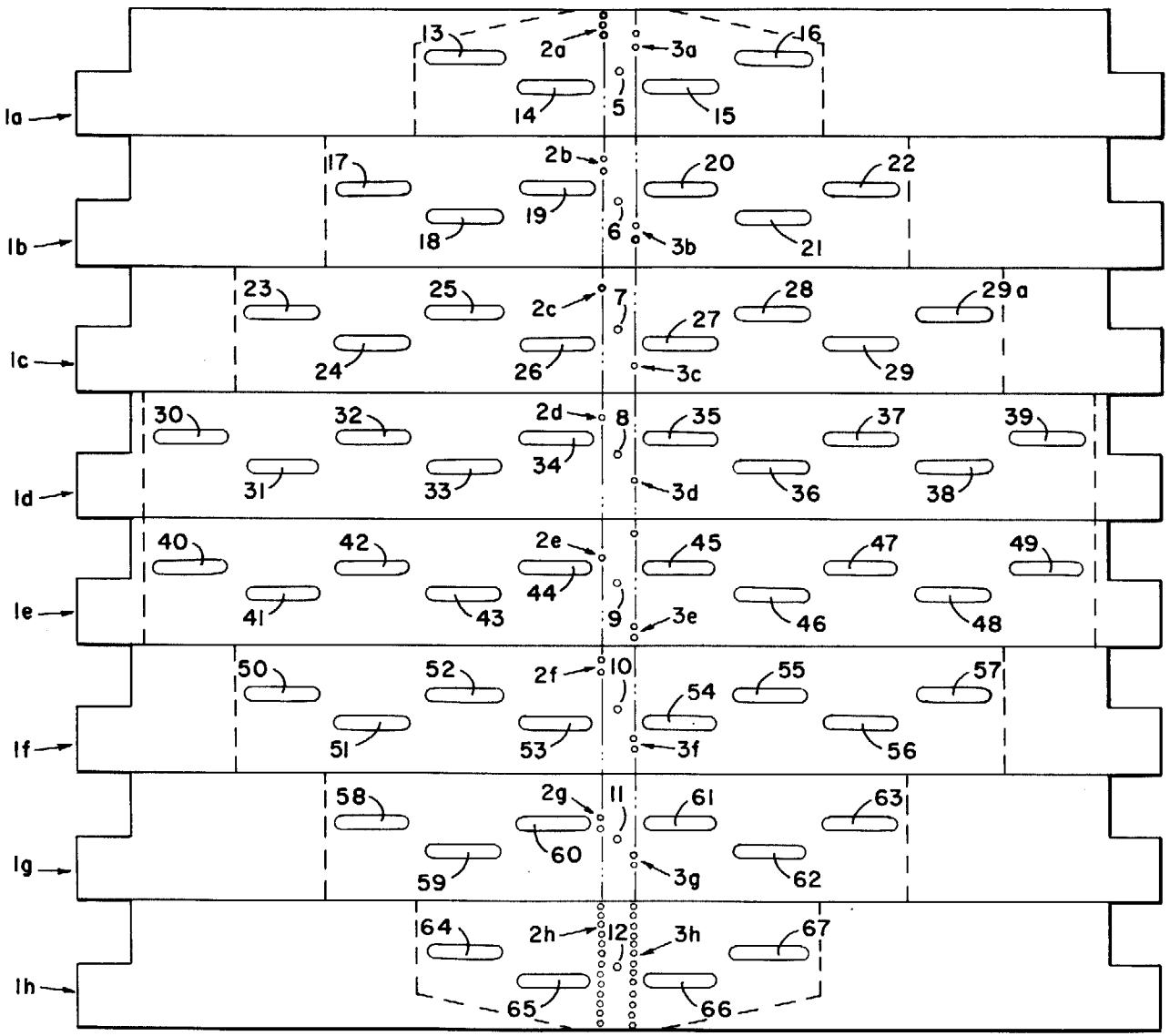
FIG. 3 is a diagrammatic showing of the front side of the composite antenna.
Figure 4:
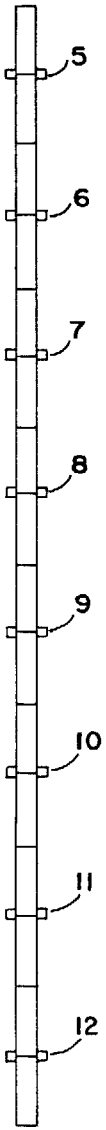
FIG. 4 is a side view of FIG. 3.
Figure 5:
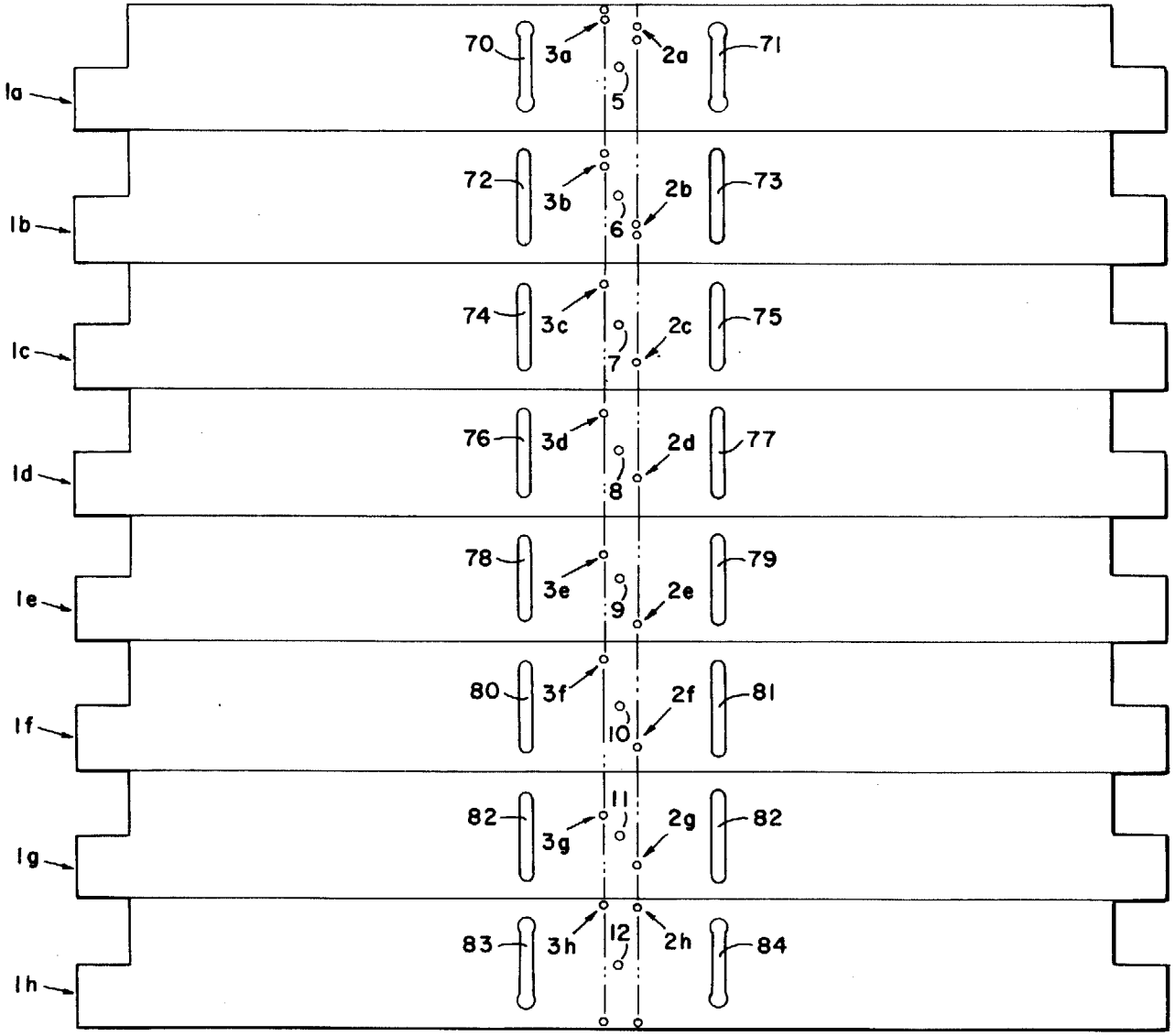
FIG. 5 is a back view of the composite antenna of the present invention.

FIGS. 3, 4 and 5 show the composite slotted planar array antenna. This slotted planar array antenna is assembled by bonding eight machine sections 1A–1H together. Each section 1A–1H is identical to section 1 shown in FIGS. 1 and 2. The bonding agent is a silver loaded conductive epoxy which also serves as a common waveguide edge wall between adjacent waveguide sections. Alignment pins 5–12 are used to hold the sections together during the bonding and the final machine steps. The antenna is copper plated by standard electroplating process which deposits the required thickness of copper on the styrofoam sections.

Displaced longitudinal shunt slots 13–67 are machined into the broadwall of the copper plated styrofoam sections. Slot dimensions are selected so that the slots appear resonant in the waveguide. The resonant impedance of the slot being determined for each required slot displacement where all slots are radiating into free space. The resonant slots are positioned in the waveguide sections in such a manner as to produce the pattern maximum in the direction normal to the plane containing the slots. With resonant slots as the radiating elements, the requried slot separation between slots staggered across the guide centerline is equal to one half the guide wavelength.

FIG. 5 shows the back side of the antenna which has slots 70–85 which are fed energy by four feed guides not shown. The feed guide slots 70–85 are dimensioned such that the slots appear resonant when the slot is coupling energy into the radiating guide. The feed guide slots appear as series slots in the radiating guide, thus they are placed one half guide wavelength from the radiating guide short circuited termination 2A–2H and 3A–3H.

Each linear array section is divided into two subunits which are each a standing wave array. One quarter of the antenna consists of four linear standing arrays having five, four, three and two slots respectively. Individual waveguide assemblies may be machined to remove excess material and the ends of each waveguide assembly plated over.

In the fabrication process, a section of styrofoam is machined to the shape shown in FIGS. 1 and 2. A hole 4 for an alignment pin is drilled into the center of this section as well as two columns of holes 2 and 3 on either side of the alignment hole. The entire styrofoam section, including the holes, is then copper plated. Following the plating operation, eight identical sections are bonded together, in a side by side fashion, by means of a conductive epoxy as shown in FIGS. 3, 4 and 5.

The next step in the fabrication process is to machine the required slots into the plated sections. The alignment pins 5–12 are used to hold the sections together during the milling operation. The top corners on each end of the sections are used to determine the centerline of each section so that the slots may be properly positioned. During the milling operation, radiating slots 13–67 are formed in the top surface of each section and feed slots 70–85 are formed in the bottom surface. Following the milling operation, the ends of each section are machined away to form the final assembly as shown in dotted lines in FIG. 3. The ends of each section are then replated.

It should be noted here that each of the eight sections now contain two enclosed waveguide sections, one end of each of said waveguide sections being formed by one of the columns of plated through holes. Two lengths of feed guide may be provided with each length containing two waveguide sections formed as described above, and then bonded, by means of conductive epoxy, to the back side of the array. Thus, each of the four feed sections feeds one quadrant of the antenna array. A waveguide bend may be used to connect each of the four feed sections to a conventional monopulse arithmetic unit.

We claim:

1. A fabricating process for an antenna comprising the steps of providing a plurality of styrofoam sections, machining these sections to identical predetermined shapes; drilling an alignment hole in the center of each section; drilling two columns of holes on either side of said alignment hole in each section; copper plating, including all holes, each section; providing a conductive epoxy; bonding the sections together in a side by side fashion with the epoxy; placing alignment pins in the alignment holes for holding the sections in place during milling; milling a plurality of slots through the copper plating of each section; machining the ends of the bonded sections to a predetermined shape; and replating the ends.

* * * * *